US008387634B2

(12) United States Patent
Dalsing

(10) Patent No.: US 8,387,634 B2
(45) Date of Patent: Mar. 5, 2013

(54) ASSISTED-MOVEMENT SYSTEM FOR ONE OF A RACK AND A DOOR OF AN APPLIANCE

(75) Inventor: Troy Dalsing, Sollentuna (SE)

(73) Assignee: Electrolux Home Products, Inc., Cleveland, OH (US)

( * ) Notice: Subject to any disclaimer, the term of this patent is extended or adjusted under 35 U.S.C. 154(b) by 503 days.

(21) Appl. No.: 12/547,031

(22) Filed: Aug. 25, 2009

(65) Prior Publication Data

US 2010/0051067 A1 Mar. 4, 2010

Related U.S. Application Data

(60) Provisional application No. 61/092,283, filed on Aug. 27, 2008.

(51) Int. Cl.
*B08B 3/02* (2006.01)

(52) U.S. Cl. ..... 134/135; 211/41.8

(58) Field of Classification Search ..... 134/135, 134/200; 211/41.8
See application file for complete search history.

(56) References Cited

U.S. PATENT DOCUMENTS

| | | | | |
|---|---|---|---|---|
| 2,573,794 | A * | 11/1951 | Kueneman | 134/138 |
| 2,722,941 | A * | 11/1955 | Bartlett | 134/141 |
| 3,466,105 | A * | 9/1969 | Guth | 312/274 |
| 3,587,939 | A | 6/1971 | Nystuen et al. | |
| 4,052,954 | A * | 10/1977 | Roy | 116/285 |
| 4,226,490 | A * | 10/1980 | Jenkins et al. | 312/331 |
| 4,794,847 | A * | 1/1989 | Kreuter et al. | 92/136 |
| 6,478,613 | B1 | 11/2002 | Zoell et al. | |
| 7,165,790 | B2 * | 1/2007 | Bella et al. | 292/34 |
| 7,309,936 | B2 | 12/2007 | Utsumi et al. | |
| 7,568,601 | B2 * | 8/2009 | Kogami et al. | 224/483 |
| 8,016,266 | B2 * | 9/2011 | Bogert | 254/124 |
| 2005/0022663 | A1 | 2/2005 | Ford | |
| 2006/0066189 | A1 * | 3/2006 | Bond et al. | 312/319.1 |
| 2007/0177995 | A1 | 8/2007 | Yano | |
| 2008/0035186 | A1 * | 2/2008 | Wegener et al. | 134/143 |
| 2009/0039745 | A1 * | 2/2009 | Wong | 312/333 |
| 2010/0130041 | A1 * | 5/2010 | Tsujimoto | 439/159 |

FOREIGN PATENT DOCUMENTS

| | | | |
|---|---|---|---|
| JP | 4-306140 | * | 10/1992 |
| JP | 2003-079557 | * | 3/2003 |
| JP | 2004/052080 A | | 2/2004 |
| JP | 2005/034376 A | | 2/2005 |

(Continued)

OTHER PUBLICATIONS

European Patent Office 1 066 789 Feb. 2001.* European Patent Office 1 323 371 Jul. 2003.*

*Primary Examiner* — Frankie L Stinson
(74) *Attorney, Agent, or Firm* — Alston & Bird LLP

(57) ABSTRACT

An assisted-movement system is provided for an appliance, such as a dishwasher including a tub portion defining a forward opening, a door pivotally engaged therewith for selectively engaging the forward opening, and a rack movable into and out of the tub portion through the forward opening. A biasing device is operably engaged between the tub portion and one of the door, via a hinge mechanism, and the rack. The biasing device is extendable between contracted and extended positions. A position control device is operably engaged between the tub portion and one of the door, the rack, and the biasing device, and is configured to cooperate with the one of the door, the rack, and the biasing device to at least one of maintain the door in a closed position and maintain the rack within the tub portion, with the biasing device in the contracted position. Associated dishwashers are also provided.

16 Claims, 6 Drawing Sheets

FOREIGN PATENT DOCUMENTS

| | | | |
|---|---|---|---|
| KR | 2006-001155 | * | 2/2006 |
| KR | 2006-017175 | * | 2/2006 |
| KR | 2006017175 | * | 2/2006 |
| KR | 2903283 | * | 5/2007 |
| KR | 200984337 | * | 12/2007 |
| KR | 201051979 | * | 4/2008 |

* cited by examiner

ASSISTED-MOVEMENT SYSTEM FOR ONE OF A RACK AND A DOOR OF AN APPLIANCE

CROSS-REFERENCE TO RELATED APPLICATIONS

This application claims the benefit of U.S. Provisional Patent Application Ser. No. 61/092,283, entitled "Assisted-Movement System for One of a Rack and a Door of an Appliance", filed Aug. 27, 2008, which is incorporated herein in its entirety by reference.

BACKGROUND OF THE INVENTION

1. Field of the Invention

Embodiments of the present invention are generally related to appliances and, more particularly, to an assisted-movement system for one of a rack and a door of an appliance, such as a dishwasher.

2. Description of Related Art

A dishwasher typically includes a tub portion for receiving dishware to be washed, wherein the tub portion defines a front or forward opening having a door member pivotably engaged therewith for sealing the opening. Often, the tub portion defines an interior space configured to receive at least one rack therein for supporting the dishware to be washed. One limitation in this typical dishwasher configuration is that, in some instances, the amount (i.e., control panels, detergent dispensers, wiring, etc.) and types (stainless steel or wooden outer door panels, etc.) of components included in the door construction may result in a relatively high (possibly excessive) weight of the door. Often, such doors may include one or more counterbalance devices for dampening the door-opening process (i.e., such that there is some resistance to the door falling open or pivoting outwardly of the dishwasher when the latch is released). With particularly heavy dishwasher doors, such counterbalance devices may, in some instances, be at risk of breakage or other failure.

In other instances, the door, whether counterbalanced or not, may otherwise be biased or spring-loaded toward the closed position. As such, in some instances, failure to appropriately regulate the door closing procedure may undesirably cause the door to slam shut, possibly resulting in a safety hazard.

In still other instances, the movement of certain components of the dishwasher, such as the door or a rack therein, may not be controlled or regulated. For example, a rack may be engaged with the tub portion via sliding rails or wheels. In those instances, movement of the rack into an out of the tub may be undesirably perceived as being harsh, flimsy, or cheaply constructed. Similarly, an inappropriately controlled or regulated door may also be undesirably perceived as being cheaply constructed.

As such, there exists a need for an apparatus and/or system for providing a more reliable and robust mechanism for assisting, controlling, and/or regulating the pivoting movement of a door of a dishwasher. Further, it may also be desirable that such an assisted-movement device and/or system address issues of user convenience, aesthetic appeal, and/or tactile function with respect to the door or other components of the dishwasher, such as the rack(s) therein.

BRIEF SUMMARY OF THE INVENTION

The above and other needs are met by embodiments of the present invention which, according to one aspect, provides an assisted-movement system for a dishwasher, wherein the dishwasher is adapted to include a tub portion having a plurality of walls defining a forward opening, and a rack movable in a plane into and out of the tub portion through the forward opening. Such an assisted-movement system comprises a biasing device operably engaged between the tub portion and the rack, wherein the biasing device is extendable between a contracted position, corresponding to the rack being disposed within the tub portion, and an extended position, corresponding to the rack being disposed at least partially outward of the tub portion. A position control device is operably engageable with one of the rack and the biasing device. The position control device is configured to cooperate with the one of the rack and the biasing device to selectively maintain the rack disposed within the tub portion, with the biasing device in the contracted position.

Another aspect of the present invention provides an assisted-movement system for a dishwasher, wherein the dishwasher is adapted to include a tub portion having a plurality of walls defining a forward opening, and a door pivotally engaged with the tub portion, via a hinge mechanism, for selectively engaging the forward opening. Such an assisted-movement system comprises a biasing device operably engaged between the tub portion and the hinge mechanism, wherein the biasing device is extendable between a contracted position, corresponding to a closed position of the door with respect to the tub portion, and an extended position, corresponding to an open position of the door with respect to the tub portion. The biasing device is further configured to damp movement of the door as the door is pivoted toward the closed position. A position control device is operably engageable with the one of the door and the biasing device, wherein the position control device is configured to cooperate with the one of the door and the biasing device to selectively maintain the door in the closed position with respect to the tub portion, with the biasing device in the contracted position.

In addition, another aspect of the present invention provides a dishwasher, comprising a tub portion having a plurality of walls defining a forward opening, a rack movable in a plane into and out of the tub portion through the forward opening, and an assisted-movement system. Such an assisted-movement system comprises a biasing device operably engaged between the tub portion and the rack, wherein the biasing device is extendable between a contracted position, corresponding to the rack being disposed within the tub portion, and an extended position, corresponding to the rack being disposed outwardly of the tub portion. A position control device is operably engageable with one of the rack and the biasing device, wherein the position control device is configured to cooperate with the one of the rack and the biasing device to selectively maintain the rack disposed within the tub portion, with the biasing device in the contracted position.

Still another aspect of the present invention provides a dishwasher, comprising a tub portion having a plurality of walls defining a forward opening, a door pivotally engaged with the tub portion, via a hinge mechanism, for selectively engaging the forward opening, and an assisted-movement system. Such an assisted-movement system comprises a biasing device operably engaged between the tub portion and the hinge mechanism, wherein the biasing device is extendable between a contracted position, corresponding to a closed position of the door with respect to the tub portion, and an extended position, corresponding to an open position of the door with respect to the tub portion. The biasing device is further configured to damp movement of the door as the door is pivoted toward the closed position. A position control device is operably engageable with the one of the door and the biasing device, wherein the position control device is configured to cooperate with the one of the door and the biasing device to selectively maintain the door in the closed position with respect to the tub portion, with the biasing device in the contracted position.

Such aspects of the present invention thus advantageously provide, for example, a provision for controlling the pivoting movement of the door with respect to the tub portion. In some instances, some aspects may be configured to selectively maintain the door in any position between the fully-open and fully-closed positions. Aspects of the present invention may also advantageously provide, for instance, an automatic door-opening provision (i.e., when implemented in conjunction with a releasable latch device, such as a "push/push" latch, engaged between the tub portion and the door) for assisting a user in loading/unloading the dishwasher. In addition, such a configuration may, in some instances, allow a handle to be deleted from the door altogether, thus providing a more hidden or relatively "cleaner" installation as an aesthetic advantage.

As such, when implemented in conjunction with a rack of a dishwasher, aspects of the present invention may also advantageously provide, for example, an automatic rack deployment provision (i.e., when implemented in conjunction with a releasable latch device, such as a "push/push" latch, engaged between the tub portion and the rack) for assisting a user in loading/unloading the dishwasher. In some instances, aspects of the present invention may be integrally incorporated into "rack slide" mechanisms. While providing advantages otherwise noted herein, such an integral configuration may further advantageously provide, for example, a more hidden or relatively "cleaner" installation as an aesthetic advantage, cost reductions, and increased stability of the rack. In still other instances, aspects of the present invention may damp the movement of the door and/or rack, wherein such damped motion may be perceived as a desirably tactile feature, indicating a high quality product.

Aspects of the present invention thus provide significant advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
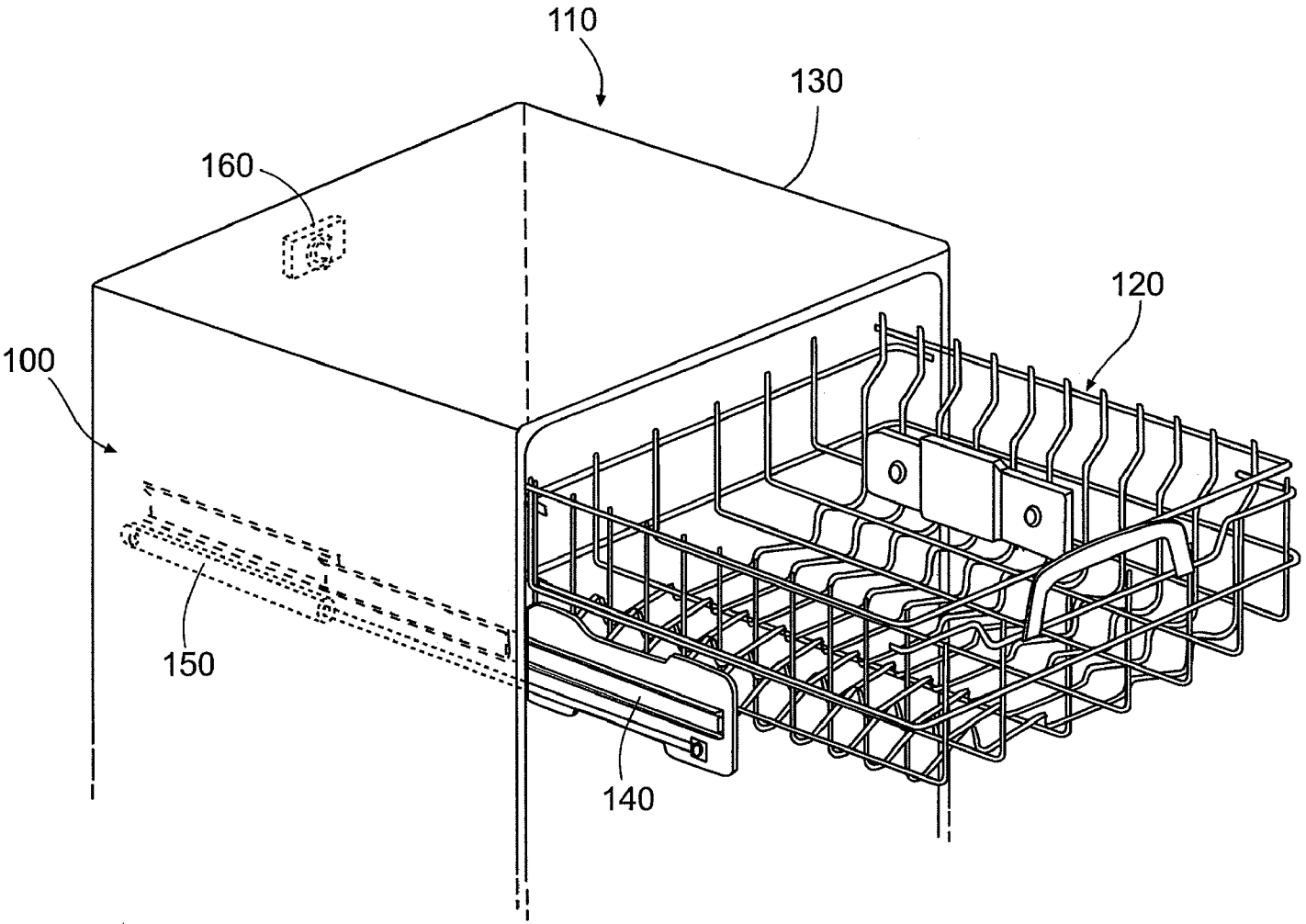
FIG. 1 illustrates an assisted-movement system for a rack of a dishwasher, according to one embodiment of the present invention.
Figure 2:
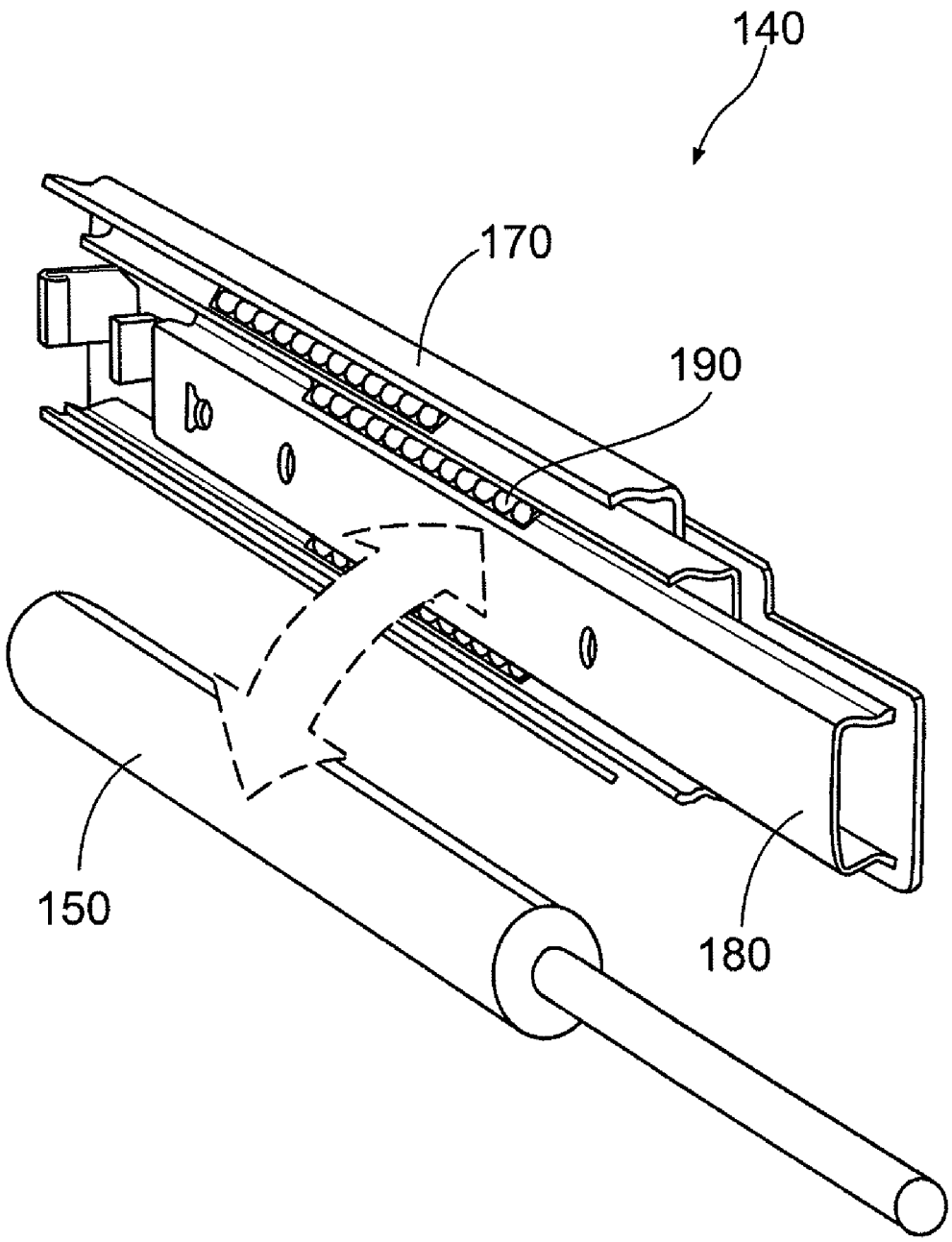
FIG. 2 illustrates various components of the assisted-movement system for a rack of a dishwasher, as shown in FIG. 1.

FIG. 1 illustrates an assisted movement system for an appliance such as a dishwasher, according to one aspect of the present invention as applied to a rack 120 received by the dishwasher 110, the system being generally indicated by the numeral 100. In some instances, the rack 120 may be an upper rack of the dishwasher 110, though aspects of the present invention may also be applicable to other racks therein. The upper rack 120 is generally slidably engaged with the tub portion 130 of the dishwasher 110 via one or more sliding mechanisms 140 such as, for example, "rack rails" as shown in FIGS. 1 and 2 (typically with a rack rail 140 engaged with each lateral side of the upper rack 120), for guiding the rack 120 into and out of the tub portion 130 along a defined plane.

In one aspect, at least one biasing device 150 is operably engaged between the rack 120 (and/or the rack rail 140 and/or any other component engaged between the rack rail 140 and the rack 120, such as a rack height adjustment mechanism) and the tub portion 130, and is extendable between a contracted position and an extended position. In one instance, the at least one biasing device 150 may comprise, for example, a normally-extended strut assembly, such as a gas-charged or fluid-charged, normally-extended strut assembly. Such a strut assembly may be extendable so as to be about twice as long in the extended position as in the contracted position. In any instance, the biasing device 150 may be desirably configured and/or operably engaged between the tub portion 130 and the rack 120 such that, when the biasing device 150 is in the extended position, the rack 120 is disposed at least partially outside the tub portion 130. In one aspect, the at least one biasing device 150 is operably engaged between the tub portion 130 and the rack 120 in a substantially parallel orientation to the plane of rack movement. A biasing device 150 configured in such a manner may be operable, for example, to normally bias the rack 120 outwardly of the tub portion 130 through a forward opening define thereby, and along the plane of rack movement defined by the rack rails. Accordingly, the assisted-movement system 100, as applied to the rack 120, may provide, for example, an "automatic" rack deployment provision upon opening the door of the dishwasher 110 (i.e., the rack 120 may be automatically biased outwardly of the tub portion 130 by the biasing device 150 when the dishwasher door is opened). In other instances, the biasing device 150 may be configured to damp the motion of the rack 120 into and/or out of the tub portion 130 along the plane of rack movement. For example, the biasing device 150 may be configured to extend and/or contract in a controlled, regulated, or otherwise damped manner such that the rack 120 does not merely move in an unrestricted manner with respect to the rack rails 140 and "slam" at the limits of travel. Accordingly, the damped motion of the rack 120 into and/or out of the tub portion 130 may provide a "soft touch," "soft action," or other desirably tactile action of the rack 120, which may be perceived, for instance, as an upscale, luxury, or quality feature.

In order to control or otherwise regulate the automatic deployment of the rack 120 upon opening the door of the dishwasher 110, aspects of the present invention may further implement a position control device 160 operably engaged between the tub portion 130 and the rack 120, wherein the position control device 160 cooperates with the at least one biasing device 150 to maintain the rack 120 in a selected disposition with respect to the tub portion 130, and with the at least one biasing device 150 between and including the contracted and extended positions. In one instance, the position control device 160 may be operably engageable with one of the rack 120 and the at least one biasing device 150, wherein the position control device 160 is configured to cooperate with the rack 120 and/or the at least one biasing device 150 to selectively maintain the rack 120 disposed within the tub portion 130, with the at least one biasing device 150 in the contracted position. In one example, the position control device 160 may comprise, in one instance, a releasable latch mechanism such as a "push/push" latch (i.e., urging the rack 120 in a first direction, such as into the tub portion 130 along the plane of rack movement, against the latch causes a locking mechanism to engage or otherwise to be actuated to a locked arrangement, to secure the rack 120 with respect to the latch and within the tub portion 130, wherein urging the rack 120 a second time against the latch, again in the first direction, causes the locking mechanism to disengage or otherwise be actuated to an unlocked arrangement, to release the rack 120 to move outwardly of the tub portion 130). As such, implementation of a position control device 160 (i.e., a "push/push" latch) between the tub portion 130 and the rack 120 (and/or the biasing device 150) thus allows the rack 120 to be selectively "automatically" deployed, upon opening the door, to assisting a user in loading/unloading the dishwasher 110, and then otherwise locked in place within the tub portion 130.

That is, when the position control device 160 is released, the at least one biasing device 150 extends from the contracted position to the extended position, and biases the rack 120 outwardly of the tub portion 130 along the plane of rack movement defined by the rack rails 140. Urging the rack 120 into the tub portion 130 (through the forward opening) into engagement with the position control device 160 (latch), until the locking mechanism engages, causes the biasing device 150 to control or damp the movement of the rack 120 into the tub portion 130, urges the biasing device 150 toward the contracted position, and causes the rack 120 to be retained within the tub portion 130. Urging the rack 120 for a second time into the tub portion 130 causes the locking mechanism of the position control device 160 to release (thereby unsecuring the rack 120), at which point the rack 120 may be released such that the at least one biasing device 150 controls or damps the movement of the rack 120 outwardly of the tub portion 130 through the forward opening thereof.

One skilled in the art will appreciate, however, that the "push/push" latch forming one aspect of the position control device 160 is but one example and is not intended to be limiting. For instance, the position control device 160 may be configured to maintain the rack 120 at any disposition between and including the contracted position and the extended position of the biasing device 150 (i.e., with the rack 120 fully contained within the tub portion 130 and the rack 120 disposed at least partially, or fully extended, from the tub portion 130), in addition to or in the alternative to selectively retaining the rack 120 within the tub portion 130.

In some instances, as shown schematically in FIG. 2, aspects of the present invention may be integrally incorporated into one or more of the rack rail or "slide" mechanisms 140. That is, a biasing device 150 may be integrated or otherwise incorporated into the rack rail mechanism 140, as will be appreciated by one skilled in the art. One skilled in the art will further appreciate that the mechanism(s) supporting the rack 120 may have a variety of configurations other than the illustrated "slide" mechanism. For example, the rack 120 may be supported by a "scissors-type" mechanism or any other suitable slide-type mechanism providing the capability of supporting the rack 120 in a stable manner within the tub portion 130, while allowing the rack 120 to be moved into and out of the tub portion 130 along the plane of rack movement, but also capable of integrating or otherwise being engaged with the at least one biasing device 150 as disclosed herein. These various rack-supporting mechanisms could, for example, serve to increase the travel of the rack 120 (outwardly of the tub portion 130) or to reduce the required size (length) of the at least one biasing device 150.

As shown in FIG. 2, the rack rail or slide mechanism 140 may include one or more slide rails 170 engaged with each other or with a slide 180 via one or more ball bearings 190. To incorporate/integrate a biasing device 150, the biasing device 150 may be particularly configured, for example, to replacing the slide 180, with the slide rails 170 changed to, for instance, a "C" shaped sectional configuration for substantially encompassing the biasing device 150. The incorporation of the biasing device 150 into the rack rail or slide mechanism 140 may help to, for example, reduce the component count and provide a more compact and aesthetically pleasing mechanism, whereby the various components are less visible to the user. While providing advantages otherwise noted herein, such an integral configuration may further advantageously provide, for example, a more hidden or relatively "cleaner" installation as an aesthetic advantage, cost reductions, and increased stability of the rack 120.

FIGS. 3A, 3B, 4A, and 4B illustrates different aspects of an assisted movement system 100 for an appliance such as a dishwasher 110, according to the present invention, as applied to a door 200 pivotally engaged with the tub portion 130 of the dishwasher 110, via one or more hinges 230. As previously discussed, a dishwasher 110 may some times include a counterbalance device 220 for damping the motion of the door 200, as the door 200 is pivoted to a fully open position. The counterbalance device 220 may be engaged, for example, between the tub portion 130 (and/or a base member 210 supporting the tub portion 130) and the hinge(s) 230. However, it may also be desirable to damp the motion of the door 200 as the door 200 is pivoted toward a closed position. Accordingly, in some aspects, at least one biasing device 150 may be operably engaged between the door 200 and/or the hinge 230, and the tub portion 130 and/or a base member 210 supporting the tub portion 130, so as to supplement or replace the counterbalance device 220, while damping motion of the door 200, at least as the door 200 is pivoted toward the closed position. In instances where the at least one biasing device 150 comprises, for example, a normally-extended strut assembly, such as a gas-charged or fluid-charged, normally-extended strut assembly, the biasing force applied thereby may applied at a controlled or restricted rate. As such, a damping effect on the pivoting motion of the door 200 between the fully-closed and fully-open positions (whether toward the closed position or toward the open position) may also be provided by the at least one biasing device 150. In one instance, where the counterbalance device 220 is implemented in conjunction with the biasing device 150, the counterbalance device 220 may be configured to counteract the biasing device 150, as the door 200 is pivoted toward the open position, such that a substantially null pivoting force is applied thereby to the door between the closed and open positions.

The embodiments illustrated in FIGS. 3A, 3B, 4A, and 4B may also implement a position control device 160, such as a "push/push" latch as previously disclosed. In such instances, the position control device 160 may be operably engaged with one of the door 200 and the tub portion 130 so as to interact with the other of the door 200 and the tub portion 130 when the door 200 is pivoted to a fully-closed position with respect to the tub portion 130, so as to selectively retain the door 200 in the fully-closed position. In other aspects, the position control device 160 may be configured to interact with the biasing device 150. In instances where such a "push/push" latch is implemented, a user may exert a force against the door 200 (already locked in the fully-closed position with respect to the tub portion 130) toward the tub portion 130 so as to release the locking mechanism, at which point the door 200 will be automatically pivoted outwardly of the tub portion 130 by the at least one biasing device 150 to the fully-opened position with respect to the tub portion 130. In instances where the biasing device 150 is balanced or nullified by the counterbalance device 220, the door 200 may have to be manually pivoted toward the fully-open position, though the pivoting motion thereof may be damped by the biasing device 150 so as to prevent the door 200 from "slamming" to the fully-open position. Pivoting the door 200, against the biasing of, and the damping effect provided by, the biasing device 150, back to the fully-closed position, and urging the door 200 toward the tub portion 130, causes the locking mechanism of the position control device 160 to engage, as previously disclosed, thereby retaining the door 200 in the fully-closed position with respect to the tub portion 130. Otherwise, the operation of the "push/push" latch is generally applicable to the door 200 in a similar manner as disclosed with respect to the rack 120. As a result, operation thereof is not repeated for the sake of brevity.

As also previously discussed, one skilled in the art will appreciate, however, that the "push/push" latch forming one aspect of the position control device 160 is but one example and is not intended to be limiting. For instance, the position control device 160 may be configured to maintain the door 200 at any disposition between and including the contracted position and the extended position of the biasing device 150 (i.e., between the fully-closed and fully-open positions of the pivoting door 200), in addition to or in the alternative to selectively retaining the door 200 in the fully-closed position with respect to the tub portion 130.

Figure 3A:
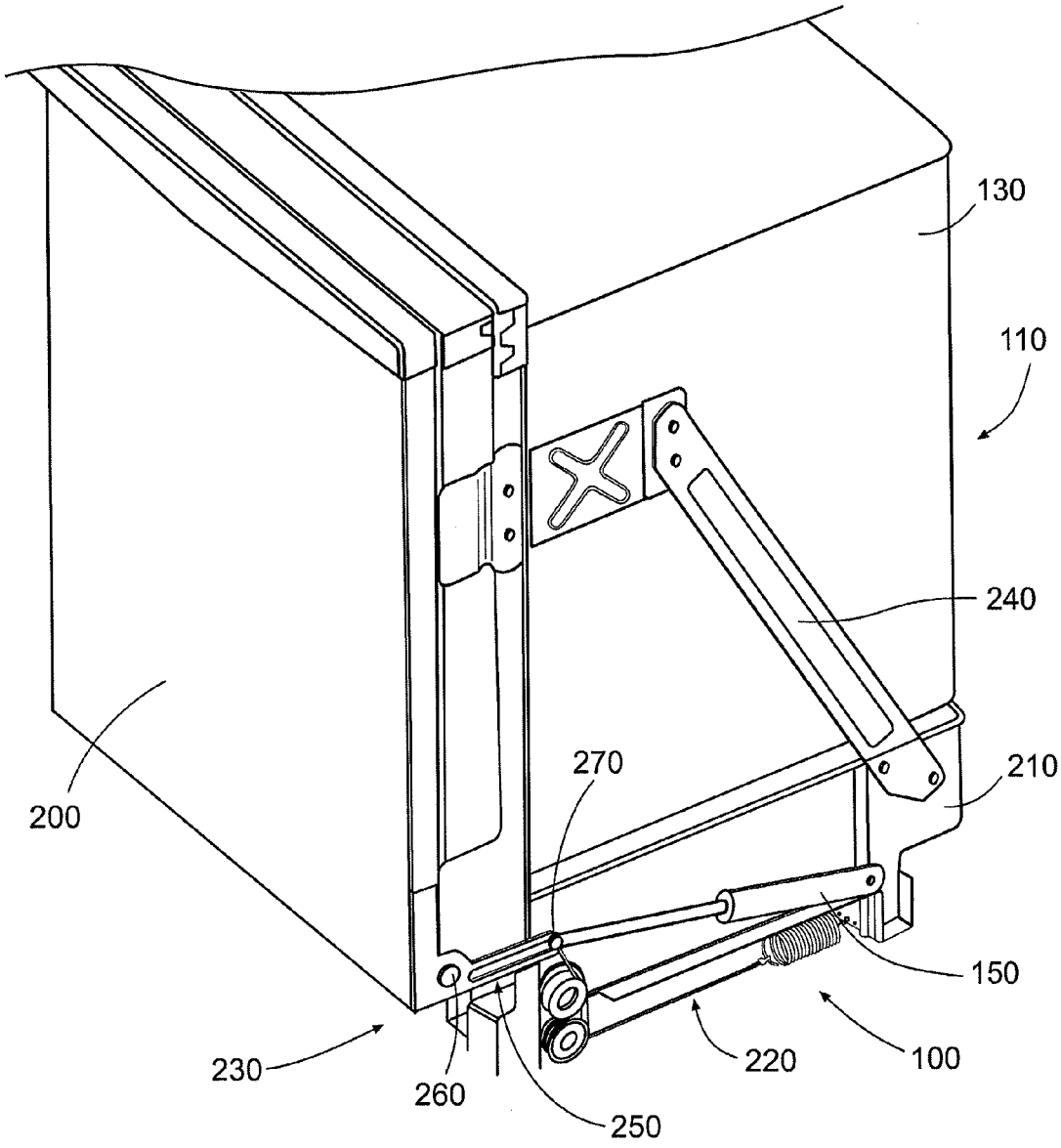
FIGS. 3A and 3B illustrate one embodiment of an assisted-movement system for a door of a dishwasher, with the door in the closed and open positions, according to the present invention.
Figure 3B:
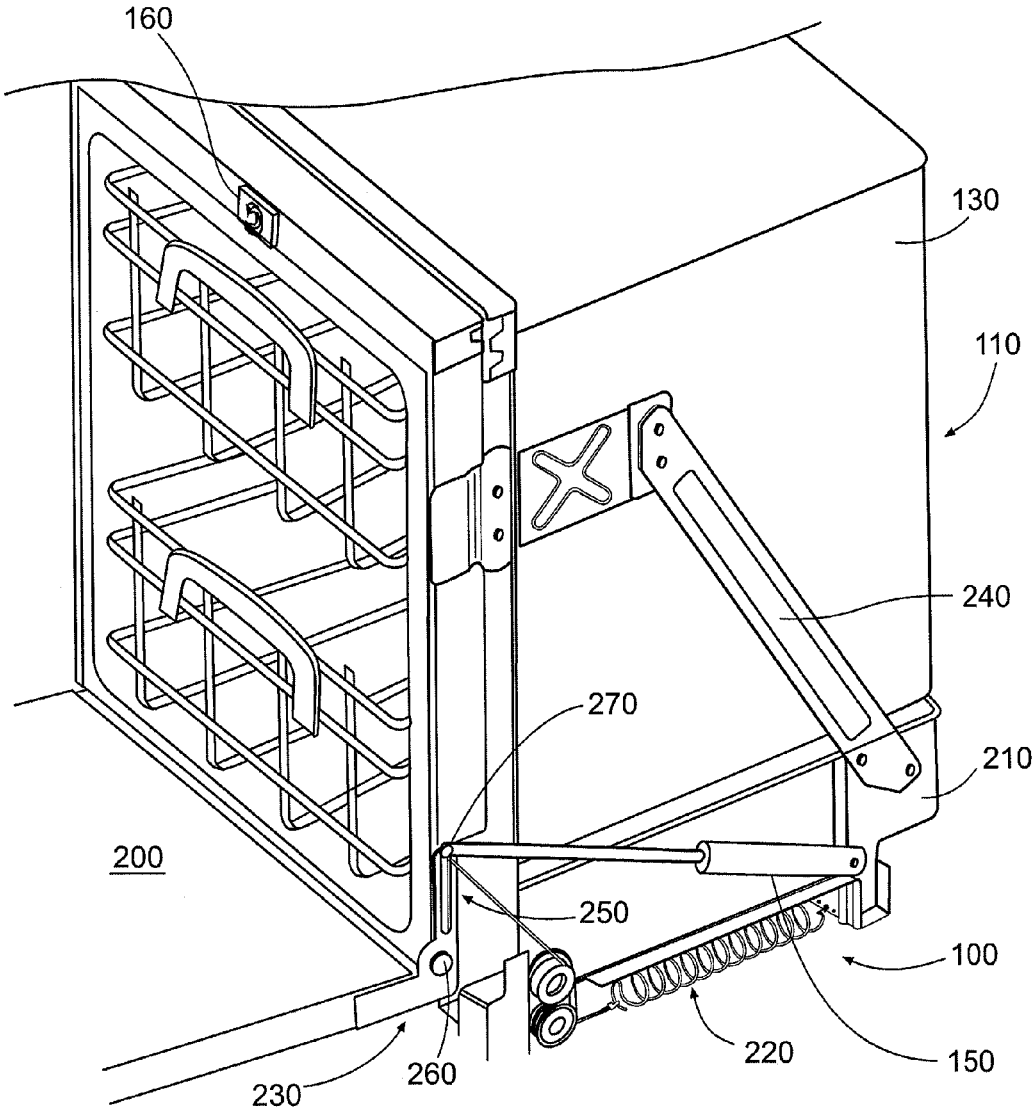

As shown in FIGS. 3A and 3B, the hinge 230 may further comprise, in some aspects, an over-center hinge mechanism having a hinge member 250 extending from a hinge point 260, wherein the door 200 is configured to be pivotable about the hinge point 260, and wherein the hinge 230 has a distal end 270 spaced apart from the hinge point 260. In some instances, the biasing device 150 may be directly engaged between the distal end 270 of the hinge member 250, and one of the tub portion 130 and a base member 210 supporting the tub portion 130. In one instance, as shown in FIGS. 3A and 3B, the at least one biasing device 150 may be operably engaged between the base member 210 and a hinge 230 associated with the pivotal mount of the door 200 to the tub portion 130. In such instances, the at least one biasing device 150 may normally bias the door 200 toward the fully-open position, while providing the aforementioned damped pivoting motion of the door 200 to the open position as a result of the controlled application rate of the biasing force imparted thereby. In some instances, the engagement between the biasing device 150 and the door 200 (i.e., via the hinge 230) may be configured such that the at least one biasing device 150 is capable of maintaining the door 220 at any pivoting position between and including the fully-open and fully-closed positions, as will be appreciated by one skilled in the art. For example, the hinge 230 may otherwise be configured so as to provide a counterforce substantially equivalent to the biasing force exerted by the at least one biasing device 150. If configured in such a manner, the at least one biasing device 150 may replace existing counterbalance devices 220 though, in some instances, existing or other counterbalance devices 220 may be implemented into the system 100 in addition to the at least one biasing device 150. One skilled in the art will further appreciate that reference herein to "at least one biasing device 150" may indicate, for example, that a biasing device 150 may be applied to one or both lateral sides of the door 200 so as to provide the functions as disclosed herein.

Figure 4A:
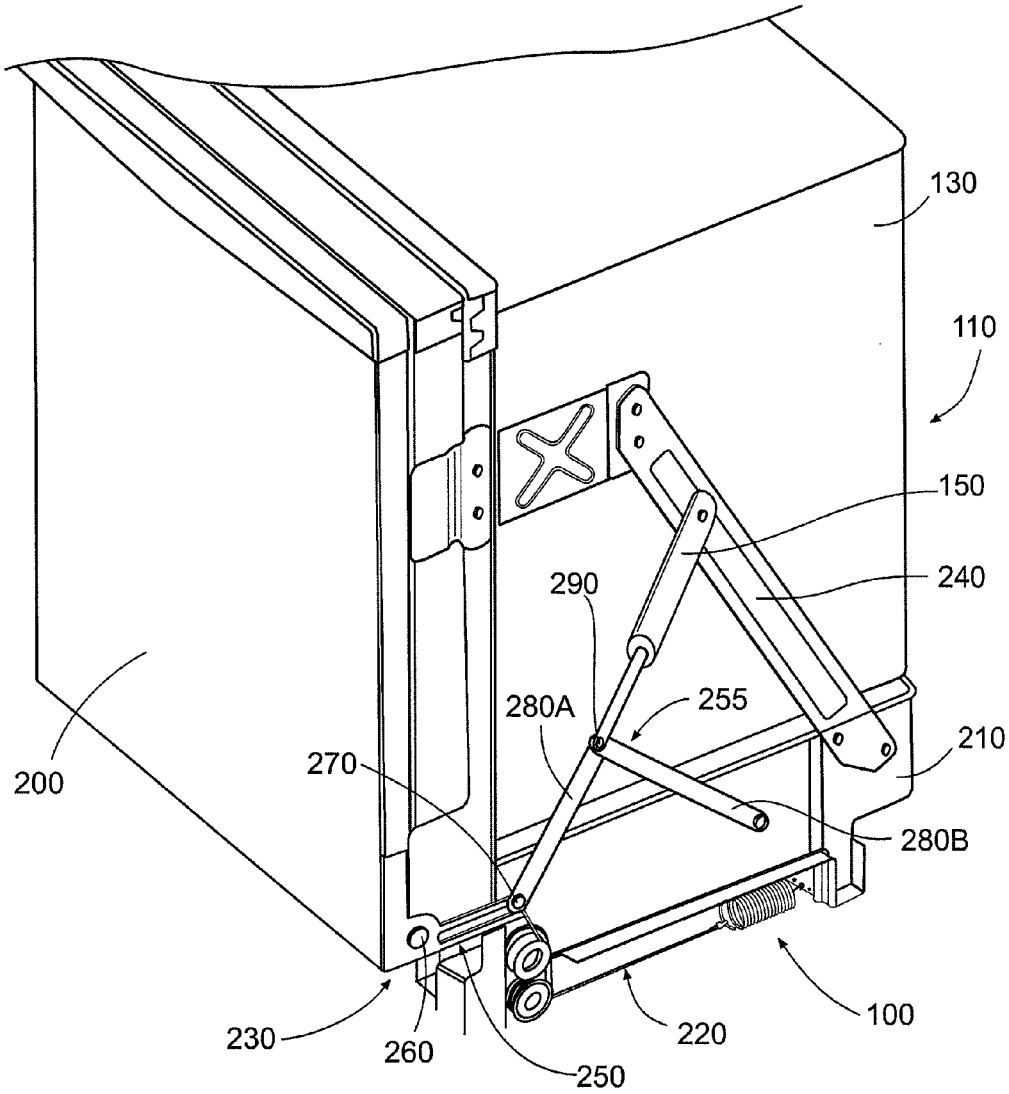
FIGS. 4A and 4B illustrate one embodiment of an assisted-movement system for a door of a dishwasher, with the door in the closed and open positions, according to the present invention.
Figure 4B:
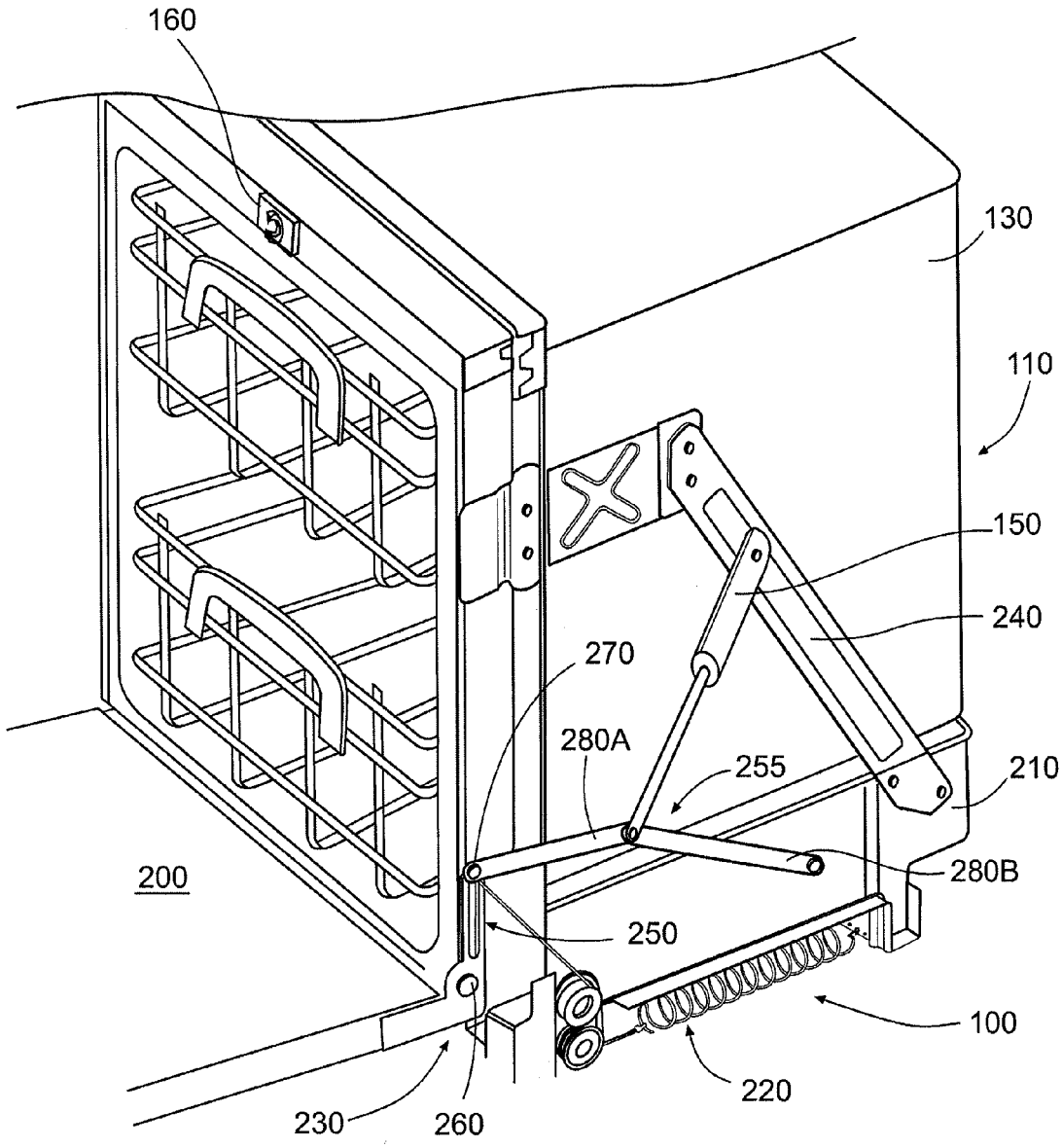

FIGS. 4A and 4B further illustrate another configuration for implementation of the assisted-movement system 100 as applied to the door 200 of the dishwasher 110. In such instances, a linkage arrangement 255 may be provided, which may include a pivot point 290 between a first linkage member 280A operably engaged with the distal end 270 of the hinge member 250, and a second linkage member 280B operably engaged with one of the tub portion 130 and the base member 210, wherein an angle between the first and second linkage members 280A, 280B increases as the door 200 is pivoted toward the open position. In such instances, the biasing device 150 may be engaged between the pivot point 290 and one of the tub portion 130 and the base member 210. In such an instance, the linkage mechanism 255 may be configured to be movable between a contracted position and an extended position as the door 200 is closed and opened, respectively. Further, the at least one biasing device 150 may be operably engaged between the linkage mechanism 255 and the tub portion 130 (i.e., via a diagonal brace 240 which may be provided for structural reasons, including, for example, securement of the base member 210 to the tub portion 130 and/or torsional reinforcement of the tub portion 130).

Embodiments and aspects of the assisted-movement system 100 of the present invention, as applied to the door 200 of the dishwasher 110, may thus advantageously provide improved control and/or feel of the pivoting movement of the door 200 with respect to the tub portion 130 including, in some instances, selectively maintaining the door 200 in any position between the fully-open and fully-closed positions. In addition, an "automatic" door-opening provision for assisting a user in loading/unloading the dishwasher 110, may also be advantageously realized. Further advantages may include, in some instances, the deletion of a handle provision from the door 200 altogether, thus providing a more hidden or relatively "cleaner" installation of the dishwasher 110 as an aesthetic advantage (i.e., deletion of the handle may allow, for example, a single, uninterrupted outer panel appearance for the dishwasher door 200). Still further, aspects of the assisted-movement system 100 may be advantageously applicable to dishwasher doors 200 of varying weights (i.e., through an adjustable linkage or other mechanism associated with the pivoting of the door 200), with improved reliability, and possibly with an improved "tactile" feel of the movement/operation of the door 200 provided by the damping effect of the biasing device 150.

Many modifications and other embodiments of the inventions set forth herein will come to mind to one skilled in the art to which these inventions pertain having the benefit of the teachings presented in the foregoing descriptions and the associated drawings. For example, aspects of the present invention, as disclosed herein, may be similarly applicable to other appliances such as, for example, refrigerators and stoves, as will be appreciated by one skilled in the art. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An assisted-movement system for a dishwasher, the dishwasher being adapted to include a tub portion having a plurality of walls defining a forward opening, and a rack movable in a plane into and out of the tub portion through the forward opening, the assisted-movement system comprising:

a biasing device operably engaged between the tub portion and the rack, the biasing device being extendable between a contracted position, corresponding to the rack being fully contained within the tub portion, and an extended position, corresponding to the rack being disposed at least partially outward of the tub portion; and a position control device operably engageable with the rack or the biasing device, the position control device being configured to engage the rack or the biasing device to selectively maintain the rack within the tub portion when the biasing device is in the contracted position, wherein actuation of the position control device is configured to release the rack or the biasing device such that the rack is automatically deployed from the tub portion via the biasing device upon actuation of the position control device.

2. A system according to claim 1 wherein the biasing device comprises a normally-extended strut assembly.

3. A system according to claim 1 wherein the biasing device comprises a fluid-charged, normally-extended strut assembly.

4. A system according to claim 1 wherein the biasing device is further configured such that, in the extended position, the rack engaged therewith is disposed at least partially outside the tub portion.

5. A system according to claim 1 wherein the biasing device is operably engaged, in a substantially parallel orientation to the plane of rack movement, between the tub portion and the rack.

6. A system according to claim 1 wherein the biasing device is configured to be normally-extended so as to normally bias the rack outwardly of the tub portion through the forward opening.

7. A system according to claim 1 wherein the biasing device is further configured to damp movement of the rack as the rack is directed out of the tub portion.

8. A system according to claim 1 wherein the biasing device is further configured to damp movement of the rack as the rack is directed into the tub portion.

9. A system according to claim 1 wherein the position control device comprises a releasable latch member operably engaged with the tub portion, the releasable latch member being configured to engage the rack, upon the rack being directed into the tub portion, so as to retain the rack within the tub portion, with the biasing device in the contracted position.

10. A system according to claim 9 wherein the latch member is configured such that interaction of the rack with the latch member along the plane of rack movement in response to the rack being directed into the tub portion, actuates the latch member to a locked arrangement for retaining the rack within the tub portion.

11. A system according to claim 10 wherein the latch member is configured such that interaction of the rack with the latch member in the locked arrangement, along the plane of rack movement and in response to the rack being directed into the tub portion, actuates the latch member to an unlocked arrangement for releasing the rack from retention within the tub portion.

12. A system according to claim 1, wherein the biasing device is extendable from the contracted position to the extended position along the same plane as the plane of rack movement.

13. A dishwasher, comprising:

a tub portion having a plurality of walls defining a forward opening;

a rack movable in a plane into and out of the tub portion through the forward opening; and an assisted-movement system comprising:

a biasing device operably engaged between the tub portion and the rack, the biasing device being extendable between a contracted position, corresponding to the rack being fully contained within the tub portion, and an extended position, corresponding to the rack being disposed at least partially outward of the tub portion; and a position control device operably engageable with the rack or the biasing device, the position control device being configured to engage the rack or the biasing device to selectively maintain the rack within the tub portion when the biasing device is in the contracted position, wherein actuation of the position control device is configured to release the rack or the biasing device such that the rack is automatically deployed from the tub portion via the biasing device upon actuation of the position control device.

14. A dishwasher according to claim 13, further comprising an upper rack and a lower rack, wherein the position control device is operably engageable with the upper rack.

15. An assisted-movement system for a dishwasher, the dishwasher being adapted to include a tub portion having a plurality of walls defining a forward opening, and a rack movable in a plane into and out of the tub portion through the forward opening, the assisted-movement system comprising:

a biasing device operably engaged between the tub portion and the rack, the biasing device being extendable between a contracted position, corresponding to the rack being disposed within the tub portion, and an extended position, corresponding to the rack being disposed at least partially outward of the tub portion; and a position control device comprising a releasable latch mechanism configured to engage the rack to maintain the rack disposed within the tub portion when the biasing device is in the contracted position, the releasable latch mechanism further configured to disengage the rack to facilitate extension of the rack via the biasing device at least partially outward of the tub portion, the releasable latch mechanism configured to selectively engage and disengage the rack in response to actuation of the rack.

16. A system according to claim 15, wherein the releasable latch mechanism is configured to selectively engage and disengage the rack in response to the rack being directed into the tub portion while the biasing device is in the contracted position.

* * * * *